US010160210B2

(12) United States Patent
Mann et al.

(10) Patent No.: US 10,160,210 B2
(45) **Date of Patent: *Dec. 25, 2018**

(54) SELECTING A NOZZLE COLUMN BASED ON IMAGE CONTENT

(71) Applicant: HEWLETT-PACKARD DEVELOPMENT COMPANY, L.P., Houston, TX (US)

(72) Inventors: Joshua A Mann, Ramona, CA (US); Clayton L Holstun, San Marcos, CA (US); Lisa A Underwood, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/306,374

(22) PCT Filed: Apr. 29, 2014

(86) PCT No.: PCT/US2014/035831
§ 371 (c)(1),
(2) Date: Oct. 24, 2016

(87) PCT Pub. No.: WO2015/167454
PCT Pub. Date: Nov. 5, 2015

(65) Prior Publication Data

US 2017/0043581 A1 Feb. 16, 2017

(51) Int. Cl.
*B41J 2/14* (2006.01)
*B41J 2/045* (2006.01)
(Continued)

(52) U.S. Cl.
CPC ..... *B41J 2/1433* (2013.01); *B41J 2/04536* (2013.01); *B41J 2/04586* (2013.01);
(Continued)

(58) Field of Classification Search
CPC .. B41J 2/1433; B41J 2/04536; B41J 2/04586; B41J 2/1753; B41J 2/17553;
(Continued)

(56) References Cited

U.S. PATENT DOCUMENTS 6,030,065 A 2/2000 Fukuhata
6,406,115 B2 6/2002 Mantell et al.
(Continued)

FOREIGN PATENT DOCUMENTS

CN 102905902 1/2013
JP 2011093227 5/2011
(Continued)

OTHER PUBLICATIONS

HP Pagewide Technology; Aug. 2012; http://h20195.www2.hp.com/V2/GetPDF.aspx/c03704438.pdf.

*Primary Examiner* — Huan Tran
*Assistant Examiner* — Alexander D Shenderov
(74) *Attorney, Agent, or Firm* — HP Inc.-Patent Department

(57) ABSTRACT

In an example, a non-transitory processor-readable medium stores code representing instructions that when executed by a processor cause a printing system to determine a text and line print mode or a graphics print mode to use for printing upcoming image content. The printing system selects a first nozzle column to print the image content when the text and line print mode is determined, and selects a second nozzle column to print the image content when the graphics print mode is determined.

14 Claims, 7 Drawing Sheets

(51) Int. Cl.
*B41J 2/175* (2006.01)
*B41J 2/21* (2006.01)

(52) U.S. Cl.
CPC ..... *B41J 2/1753* (2013.01); *B41J 2/17553* (2013.01); *B41J 2/2139* (2013.01); *B41J 2/2146* (2013.01); *B41J 2002/14475* (2013.01); *B41J 2202/20* (2013.01)

(58) Field of Classification Search
CPC ..... B41J 2/2139; B41J 2/2146; B41J 2202/14475; B41J 2202/20
USPC ..... 347/14
See application file for complete search history.

(56) References Cited

U.S. PATENT DOCUMENTS 7,350,902 B2 4/2008 Dietl et al.
7,588,305 B2 9/2009 Knierim et al.
7,618,116 B2 11/2009 Hamasaki et al.
8,408,669 B2 4/2013 Rueby
2002/0051166 A1* 5/2002 Tomita ..... G06F 3/1206 358/1.13
2002/0080210 A1 6/2002 Verhoest et al.
2004/0227786 A1* 11/2004 Muraoka ..... B41J 2/0456 347/40
2006/0038842 A1 2/2006 Chikuma et al.
2006/0050107 A1 3/2006 Yamanaka et al.
2007/0139510 A1 6/2007 Hamasaki et al.
2009/0002447 A1* 1/2009 Takei ..... B41J 2/1433 347/47
2009/0059248 A1 3/2009 Uemura et al.
2010/0149240 A1* 6/2010 Nakanishi ..... B41J 2/2139 347/12
2010/0245855 A1 9/2010 Murray et al.
2012/0001975 A1 1/2012 Rueby
2013/0063510 A1 3/2013 Rice et al.
2014/0132675 A1* 5/2014 Gargir ..... B41J 2/04593 347/68
2014/0375710 A1* 12/2014 Blair ..... B41J 2/07 347/9

FOREIGN PATENT DOCUMENTS

TW 201202050 A 1/2012
WO WO-2012/156961 3/2014

* cited by examiner

SELECTING A NOZZLE COLUMN BASED ON IMAGE CONTENT

BACKGROUND

Inkjet printing systems form printed images by ejecting print fluids onto various print media. Such printing systems generally include multi-pass, scanning type systems, and single-pass, page-wide systems. In a single-pass printing system, an array of printheads extends the full width of a media page (e.g., cut sheet or media web), which allows the entire width of the page to be printed simultaneously. The array of printheads is usually fixed on a stationary carriage or print bar, and the media page is moved past the array in a continuous manner along a media transport path while an image is printed on the page. A complete image is often printed in a single printing pass. By contrast, in a scanning type printing system, a scanning carriage holds one or more printheads and scans the printheads across the width of a media page as the printheads print one swath of an image at a time. Between each print swath, the page advances in an incremental fashion underneath the carriage in a direction perpendicular to the direction of the scanning carriage.

With single-pass printing devices in particular, there is an image quality tradeoff to be made between image content that is primarily lines or text, and image content that is primarily graphics and area fills. In general, it has not been possible to provide the best image quality with both of these types of image content using a single print mode. This is because the printing techniques useful for optimizing the sharpness of line/text image content create undesired artifacts in color transitions and gradients of graphics and area fill image content.

BRIEF DESCRIPTION OF THE DRAWINGS

Examples will now be described with reference to the accompanying drawings, in which.

Throughout the drawings, identical reference numbers designate similar, but not necessarily identical, elements.

DETAILED DESCRIPTION

Figure 1:
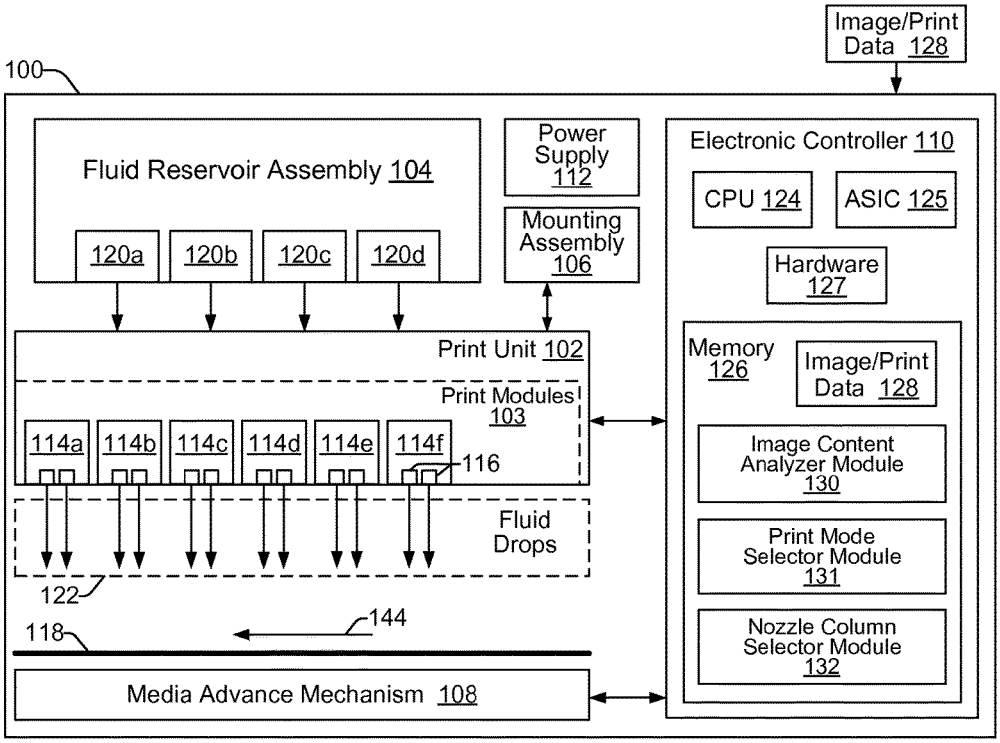
FIG. 1 shows a block diagram of an example inkjet printing system suitable for implementing fluid ejection devices having divergent nozzle columns that are dynamically selectable to print portions of an image based on the type of image content being printed.

Wide format, page-wide printers can produce large quantities of printed images very quickly. The images can include, for example, architectural and engineering drawings that comprise significant amounts of lines and text, and graphics and area fill images. The high printing speed is achieved in part by having a fixed array of printhead nozzles covering an entire width of a print zone, which allows print media to enter the print zone at one side, make a single pass underneath the nozzles, and then exit the print zone on the other side as a completed print.

When printing different types of image content (i.e., text/lines, or graphics/area fills), such page-wide printers can produce image quality defects related to the shape of the ink dots formed on the media page. This is because the optimum ink dot shape when printing text and lines is not the same as the optimum ink dot shape when printing graphics and area fills. The quality of text and lines is strongly correlated to the sharpness of the edges of the text and lines. The edges are created by placing a round ink drop in a precise location, and the edges appear more ragged if the head of the drop is in the wrong location, or if the tail of the drop does not land on the head of the drop. As used herein, an "ink dot" generally refers to an amount of ink that has impacted and marked a media page, such as when describing the shape or other characteristic of the ink on the media page, while an "ink drop" refers to an amount of ink as it travels from an ejection nozzle toward the media page, prior to the ink impacting the media page. Ink dots formed on a media page by ink drops whose heads and tails separate during drop ejection are not ideal for providing the clear, sharp edges desired for printing high quality text and line image content. High print quality for text and line image content is better achieved through clear and sharp edges that can be created when the tail of the ink drop lands on the head of the ink drop as the drop hits the media page.

However, when printing graphics and area fill image content with a single-pass system, there is a different basis for the print quality. As speed and ink flux increase, there is a mechanism that causes the tail of the ink drop to land away from the head, instead of on the head. This change results in a different dot shape on the media page that affects the amount of white space covered by the dot. Changes in the dot shape are evident under magnification. However, because the changes in the dot shape effectively alter the optical density (OD) on the media page, they are also noticeable to the unaided eye as a pattern of alternating bands of light and dark. Thus, while the absolute value of the OD may not be critical to print quality, variations in the OD can have a significant negative impact on print quality. Therefore, the shape of the dots on the media page is important, because well formed dots that generally result when the tail of the ink drop lands on the head of the ink drop will create a lighter OD, while dots formed from ink drops whose drop tails land off of their drop heads will create a darker OD.

Accordingly, examples discussed herein implement fluid ejection devices (i.e., printheads) having different nozzle columns for each ink supply that help to optimize print quality based on an analysis and consideration of the type of image content to be printed. For each fluid/ink slot on a printhead that supplies ink to two nozzle columns, for example, the nozzles in the two nozzle columns have different features that are better suited to produce higher print quality for a particular type of image content. The different nozzle features in the two nozzle columns optimize print quality by producing different ink drop characteristics that result in different dot shapes when landing on a media page.

A printing system analyzes incoming image data and determines if the image content to be printed is text and lines image content, or graphics and area fill image content. The printing system then dynamically selects which nozzle column to use for each portion of the image content based on the type of image content being printed. Thus, for text and lines image content the system may select a first nozzle column to print the content, and for graphics and/or area fill image content, the system may select a second nozzle column to print the content.

In one example, a printhead includes a fluid slot to supply ink to a first nozzle column with first nozzles, and to a second nozzle column with second nozzles. A first feature is associated with the first nozzles to produce a first dot shape for text and line image content, and a second feature is associated with the second nozzles to produce a second dot shape for graphics image content.

In another example, a non-transitory processor-readable medium stores code representing instructions that when executed by a processor cause a printing system to determine a text and line print mode or a graphics print mode to use for printing upcoming image content. The printing system selects a first nozzle column to print the image content when the text and line print mode is determined, and selects a second nozzle column to print the image content when the graphics print mode is determined.

In another example, a method of operating a printing system includes determining an image content type to be printed from an upcoming image portion. In a printhead having ink slots to supply ink to a first nozzle column with nozzles having first nozzle features, and to supply ink to a second nozzle column with nozzles having second nozzle features, the method includes selecting the first nozzle column to print the upcoming image portion based on the determined image content type. The method includes printing the upcoming image portion using the first nozzle column.

FIG. 1 shows a block diagram of an example inkjet printing system 100 (i.e., printer) suitable for implementing fluid ejection devices having divergent nozzle columns dynamically selectable to print portions of an image based on the type of image content being printed. In this example, fluid ejection devices are implemented as fluid drop jetting printheads 114 (illustrated as printheads 114*a*-114*f*). Inkjet printing system 100 includes a print unit 102, one or multiple print modules 103 of the printing unit, a fluid reservoir assembly 104, a mounting assembly 106, a media advance mechanism 108, an electronic printer controller 110, and a power supply 112 that provides power to the various electrical components of inkjet printing system 100. Each print module 103 includes multiple printheads 114 (i.e., printhead dies) to eject drops of printing fluid through a plurality of orifices or nozzles 116 toward a media page 118 so as to print onto the media page 118. In some examples, a media page 118 can be a precut media sheet supplied by a media advance mechanism 108 implemented as an input media tray, and may comprise any type of suitable print medium sheet material, such as paper, card stock, transparencies, Mylar, and the like. In other examples, a media page 118 may comprise a continuous media web supplied by a roll of media from an unwinding media advance mechanism 108. Typically, nozzles 116 are arranged in columns or arrays such that properly sequenced ejection of ink from nozzles 116 causes text (e.g., characters and symbols), lines, and/or graphics with area fills to be printed upon a media page 118 as the print unit 102 and media page 118 move relative to each other.

Fluid reservoir assembly 104 supplies printing fluids to print unit 102 and includes reservoirs 120*a*-120*d* for storing the printing fluids. In one example, each fluid reservoir 120*a*-120*d* supplies a different colored fluid ink to a corresponding fluid/ink slot 208 (FIG. 2) within the printheads 114 of a print module 103. Printing fluids stored within reservoirs 120 can include different colored inks, as well as printing treatment fluids such as a pre-treatment fluid and a post-treatment fluid. In some examples, such as the example shown in FIG. 1, four different colored inks are stored in fluid reservoirs 120*a*-120*d* comprising the respective ink colors of cyan, magenta, yellow, and black (CMYK). Base colors can be reproduced on a print media page 118 by depositing a drop of one of these inks onto the page. Secondary colors can also be reproduced on a print media page 118 by combining the CMYK ink colors in different ways. In particular, secondary or shaded colors can be reproduced by depositing drops of different base colors on adjacent dot locations of a media page 118. While four color ink reservoirs 120*a*-120*d* containing the four colors, CMYK, are discussed in the current example, other examples can include additional ink reservoirs containing additional ink colors to be deposited on a media page 118 by additional printheads and/or additional fluid slots within the printheads. For example, a CcMmYK printing system can include additional ink reservoirs for light cyan (c) and light magenta (m).

The printing fluids in fluid reservoir assembly 104 flow from individual reservoirs 120 to the print unit 102, and the fluid reservoir assembly 104 and print unit 102 can form a one-way ink delivery system or a recirculating ink delivery system. In a one-way ink delivery system, substantially all of the printing fluid supplied to print unit 102 is consumed during printing. In a recirculating ink delivery system, a portion of the printing fluid supplied to print unit 102 is consumed during printing, and another portion that is not consumed is returned to the fluid reservoir assembly 104.

In some examples, a print module 103 is implemented as a print cartridge or pen that can include part of a fluid reservoir 104 housed within the cartridge. In this case reservoirs 120 can include local reservoirs located within the cartridge, but may also include larger reservoirs located separately from the cartridge to refill the local reservoirs through an interface connection, such as a supply tube. In another example, the fluid reservoir assembly 104 is separate from the print unit 102 and print modules 103, and supplies printing fluids to the print unit 102 through an interface connection. In either example, reservoirs 120 of fluid reservoir assembly 104 can be removed, replaced, and/or refilled.

Figure 2:
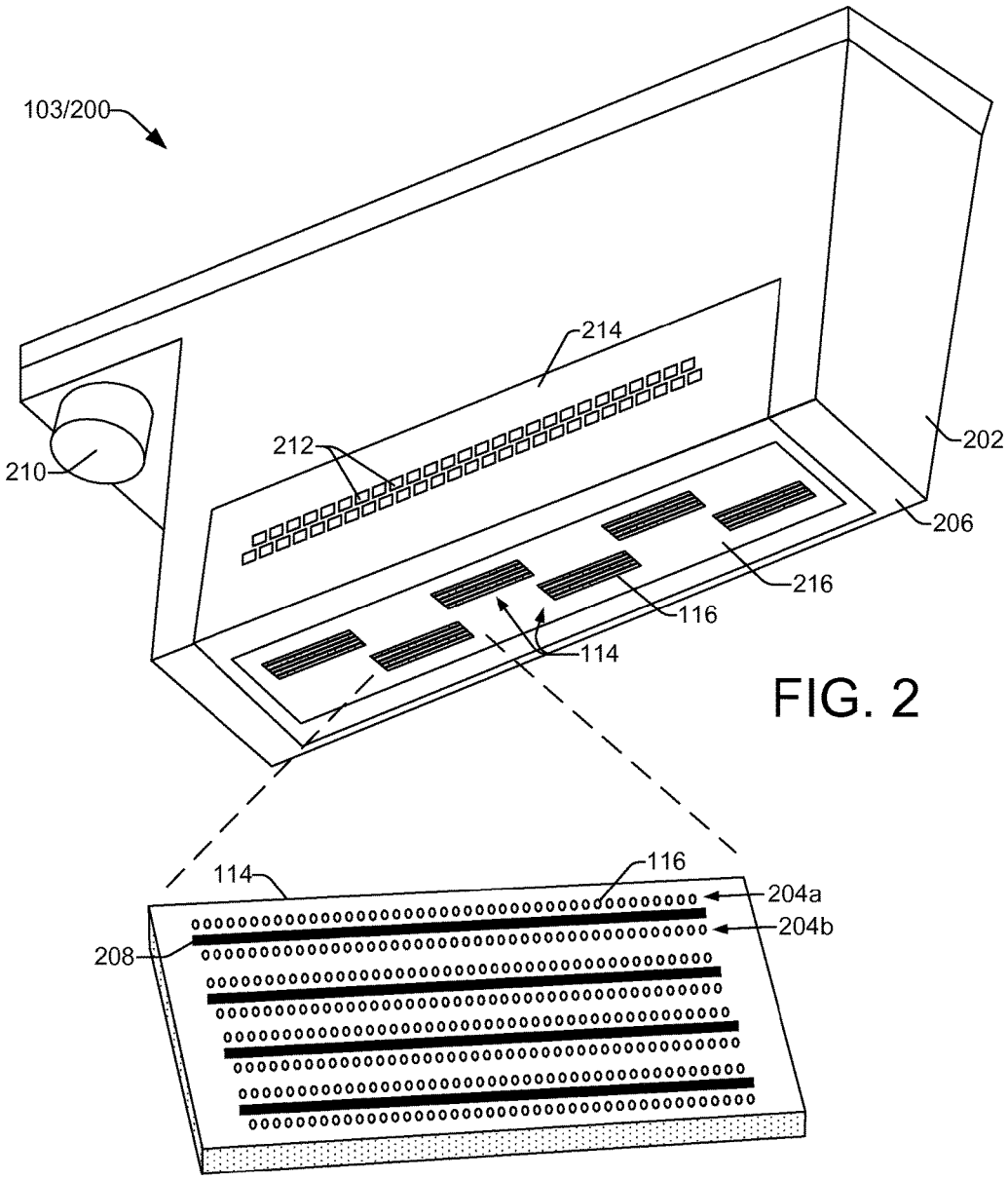
FIG. 2 shows a perspective view of an example print module implemented as a print cartridge suitable for use within the inkjet printing system of FIG. 1.

FIG. 2 shows a perspective view of an example print module 103 implemented as a print cartridge 200. Referring to FIGS. 1 and 2, print cartridge 200 includes a number of printheads 114, such as printheads 114*a*-114*f*, supported by a cartridge housing 202. Each printhead 114 comprises a printhead die substrate adhered or otherwise affixed to an underlying fluid distribution manifold (not shown) within the cartridge housing 202. Each printhead 114 includes nozzle columns 204 (illustrated as nozzle columns 204*a* and 204*b*) comprising nozzles 116 arranged generally along the length of the printhead. Each nozzle 116 is part of a drop generator formed within the printhead 114 that includes a fluid-filled ejection chamber (not shown) and a fluid ejection element (not shown). Thus, each nozzle 116 has an associated fluid ejection element within the printhead 114 to eject drops of printing fluid (e.g., ink, treatment fluid) according to activation control signals from controller 110. A drop generator implements a fluid ejection mechanism within a fluid-filled ejection chamber to force fluid drops out of a nozzle 116. The fluid ejection mechanism can take on a number of different forms, such as those using thermal or piezoelectric printhead technologies. Thermal inkjet printheads eject fluid drops from a nozzle by passing electrical current through a resistive heating element to generate heat and vaporize a small portion of the fluid within a fluid-filled ejection chamber. Piezoelectric inkjet printheads use a piezoelectric material actuator to generate pressure pulses within a fluid-filled ejection chamber that force ink drops out of a nozzle.

In the example print module 103 (print cartridge 200) of FIG. 2, printheads 114 are arranged generally end to end along a length of the bottom portion 206 of the housing 202 in a staggered configuration in which one or both ends of a printhead can overlap the ends of adjacent printheads. Each printhead 114 has four fluid slots 208 formed therein that correspond with the underlying fluid distribution manifold in a manner that enables a different colored fluid ink to flow to each slot. In other examples, a printhead 114 may have more or less fluid slots 208, and the fluid slots may correspond with the fluid distribution manifold in a manner that enables the same colored ink to flow to more than one slot. During a normal printing operation, ink flows from the underlying fluid distribution manifold into the fluid slots 208 of the printhead 114, and then into firing chambers where it is ejected by an ejection element through nozzles 116 as ink drops.

As shown in the example print module 103 of FIG. 2, each fluid slot 208 in a printhead 114 supplies fluid ink to two adjacent nozzle columns, 204*a* and 204*b*, that generally run along the length of the slot and on either side of the slot. In some examples, as discussed below, one of the two nozzle columns (e.g., column 204*a*) can have nozzles 116 with a design feature that enables the production of ink drops that form ink dots of a first shape on a media page 118, while the other of the two nozzle columns (e.g., column 204*b*) can have nozzles 116 with a design feature that enables the production of ink drops that form ink dots of a second shape on a media page 118. In different examples, the size, number, and pattern of nozzles 116 can vary. Nozzles 116 can be arranged into groups called primitives and/or any number of subsections with each subsection having a particular number of primitives.

A print module 103 can be fluidically connected through a fluid port 210 to a printing fluid supply, such as fluid supplies within a fluid reservoir assembly 104. Print module 103 can be electrically connected to controller 110 through electrical contacts 212 formed in a flex circuit 214 affixed to the cartridge housing 202. Signal traces (not shown) embedded within flex circuit 214 connect contacts 212 to corresponding contacts (not shown) on each printhead 114. Nozzles 116 on each printhead 114 are exposed through an opening 216 in the flex circuit 214 along the bottom portion 206 of the cartridge housing 202.

Figure 3:
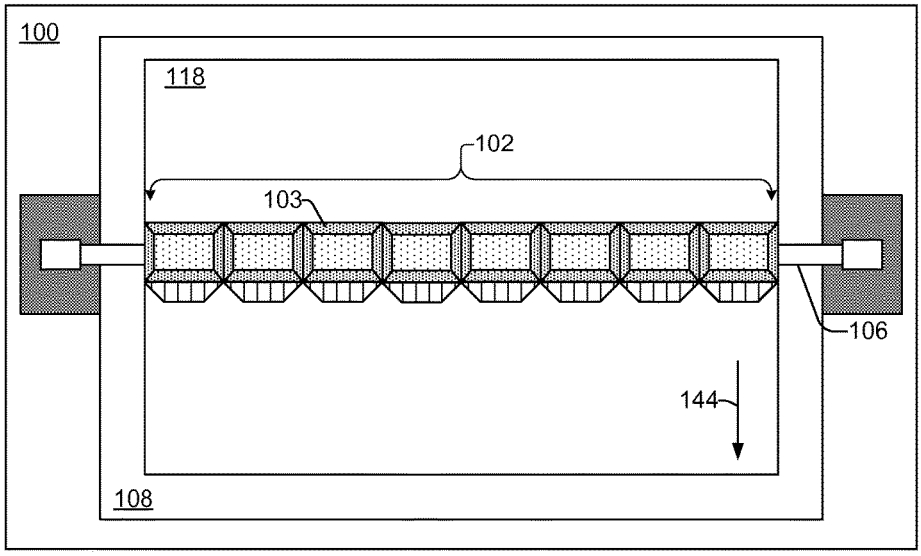
FIG. 3 shows an example of an inkjet printing system implemented as a single-pass, page-wide printing system.

Referring again to FIG. 1, mounting assembly 106 positions the print unit 102 relative to media advance mechanism 108, and media advance mechanism 108 positions media page 118 relative to print unit 102. Thus, a print zone 122 is defined adjacent to nozzles 116 in an area between the print unit 102 and media page 118. In one example, inkjet printing system 100 is a single-pass, page-wide printing system such as the printer 100 shown in FIG. 3. In the single-pass, page-wide inkjet printer 100, mounting assembly 106 comprises a print bar that supports multiple print modules 103 of the print unit 102 that provide an array of printheads 114 extending across the full width of a media page 118 (e.g., cut sheet or media web), which allows the entire width of the page to be printed simultaneously. Thus, during a printing operation the print modules 103 of print unit 102 remain stationary while a media page 118 moves under them in a continuous manner in the media advance direction 144. While examples herein are discussed with respect to a single-pass, page-wide printing system, such examples are also applicable in other printing systems such as scanning type printing systems in which printheads are scanned across the width of a media page one print swath at a time, and the media page is incrementally advanced in a media advance direction after each swath is printed.

Media advance mechanism 108 can include various mechanisms that facilitate the advancement of a media page 118 through a media path of printing system 100. Such mechanisms can include, for example, input media trays for precut sheet media, unwinding devices for rolled media webs, various media advance rollers, a motor such as a DC servo motor or a stepper motor that powers the media advance rollers, and so on. In some implementations, a media advance mechanism 108 can include other mechanisms or additional mechanisms to advance a media page 118, such as a moving platform.

Referring still to FIG. 1, inkjet printing system 100 includes an electronic controller 110 to execute print jobs received from an outside source such as a host computer system (not shown). Electronic controller 110 includes a processor (CPU) 124, a memory 126, firmware, and other printer electronics for communicating with and controlling print unit 102, mounting assembly 106, and media advance mechanism 108. In some examples, electronic controller 110 may also include an ASIC 125 (application specific integrated circuit) and/or additional hardware components 127 to perform certain operations of the printing system 100 alone or in combination with a processor 124 executing program instructions as discussed below. Thus, hardware components 127 can include physical components such as programmable logic arrays (PLAs), programmable logic controllers (PLCs), other logic and electronic circuits, and/or combinations of such physical components with programming executable by a processor.

Memory 126 can include both volatile (i.e., RAM) and nonvolatile (e.g., ROM, hard disk, floppy disk, CD-ROM, etc.) memory components. The memory components of a memory 126 comprise non-transitory computer/processor-readable media that provide for the storage of computer/processor-readable coded program instructions, data structures, program instruction modules, and other data for printing system 100, such as modules 130, 131, and 132. The program instructions, data structures, and modules stored in memory 126 may be part of an installation package that can be executed by processor 124 to implement various examples, such as examples discussed herein. Thus, memory 126 may be a portable medium such as a CD, DVD, or flash drive, or a memory maintained by a server from which the installation package can be downloaded and installed. In another example, the program instructions, data structures, and modules stored in memory 126 may be part of an application or applications already installed, in which case memory 126 may include integrated memory such as a hard drive. As noted, components of memory 126 comprise a non-transitory medium that does not include a propagating signal.

Electronic controller 110 can receive image/print data 128 from a host system, such as a computer, and store the data 128 in memory 126. Typically, data 128 comprises RIP (raster image processor) data that is in an appropriate image file format (e.g., a bitmap) suitable for printing by printer 100. Image data 128 represents, for example, a document or image file to be printed. As such, image data 128 forms a print job for inkjet printing system 100 that includes print job commands and/or command parameters. Using image data 128, electronic controller 110 controls print unit 102 to eject imaging fluid drops from nozzles 116. Imaging drops comprise fluid drops (e.g., ink drops) ejected to reproduce a digital image from the image data 128 on a media page 118. Thus, electronic controller 110 defines a pattern of ejected ink drops that form text (e.g., characters and symbols), lines, and/or other graphics or images on media page 118. The pattern of ejected ink drops is determined by the print job commands and/or command parameters from image data 128.

Figure 4:
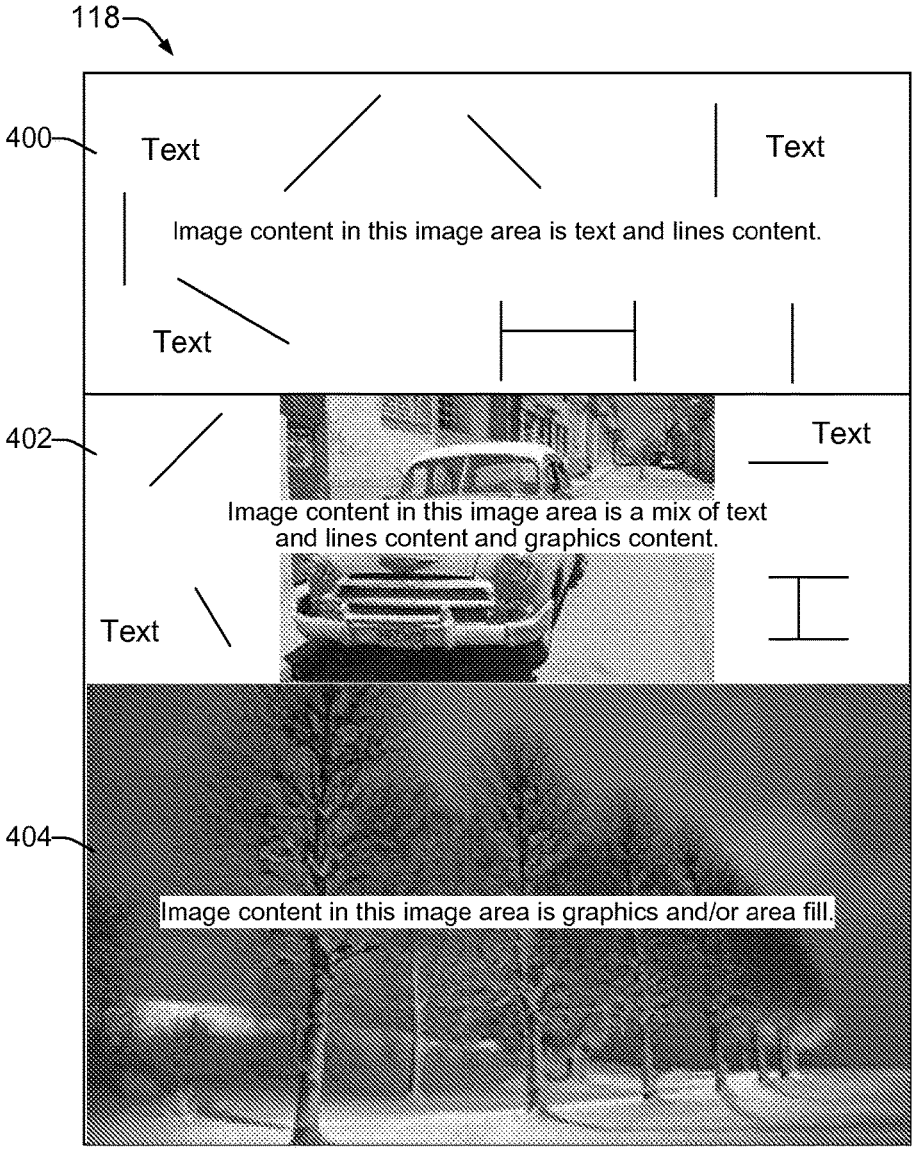
FIG. 4 shows an example of a media page printed by the example inkjet printing system of FIG. 1.

In some examples, electronic controller 110 includes an image content analyzer module 130 stored in memory 126. Module 130 comprises program instructions executable on processor 124 to analyze and determine upcoming image content from image data 128. For example, image content can be determined to be text and lines content, or graphics and area fill content, or some combination and/or proportion of text and lines with graphics and area fill. In some examples, module 130 may additionally analyze nozzles to determine which nozzles are missing or defective. As shown in FIG. 4, an example media page 118 is printed by an example printer 100 and includes printed images 400, 402, and 404. The image content in image 400 comprises text and line content, the image content in image 402 comprises a mixture of text and line content with graphics and/or area fill image content, and the image content in image 402 comprises graphics and/or area fill image content. Prior to printing images 400, 402, and 404, controller 110 analyzes the image data 128 to determine what image content is in each of the images. In some examples, controller 110 determines the proportions of different types of image content that make up an image, or one media page, or a complete print job. In some examples, controller 110 determines different sections of a same image that contains different types of image content, such as in image 402 which contains different sections of text and line content, graphics and/or area fill content. To distinguish between different image content (e.g., text/lines or graphics and area fill) from image data 128, program instructions from module 130 may implement any of a number of known edge or line detection algorithms suitable for separating an image into a line detail sub-image and an area fill detail sub-image. One example of such an algorithm is John F. Canny's edge detector algorithm which is appropriate for separating and/or splitting the image into the line detail sub-image and the area detail sub-image. A description of the Canny's edge detector algorithm can be taken, e.g. from Canny, J., A Computational Approach to Edge Detection, IEEE Trans. Pattern Analysis and Machine Intelligence, 8(6), pp. 679-698, 1986, or R. Deriche, Using Canny's Criteria to Derive a Recursively Implemented Optimal Edge Detector, Int. J. Computer Vision, Vol. 1, pp. 167-187, April 1987, or from references and/or textbooks.

Electronic controller 110 also includes a print mode selector module 131 stored in memory 126. Module 131 comprises program instructions executable on processor 124 to select a print mode based on user input information. In this example, the print mode selector 131 selects between two different print modes. A first print mode is a text and lines print mode, and a second print mode is a graphics and area fill print mode. Thus, if a user knows what type of image content is to be printed in an upcoming job, the user can input this information into the printing system 100, indicating a desired print mode. Module 131 executing on controller 110 will receive the user input information and select the appropriate print mode to best accommodate the image content to be printed.

Electronic controller 110 also includes a nozzle column selector module 132 stored in memory 126. Module 132 comprises program instructions executable on processor 124 to select a column of nozzles to print an image or portion of an image. The nozzle column selection is based on either a user-selected print mode from module 131 or the type of image content determined by module 130. Thus, controller 110 first interprets image data 128 to determine which fluid/ink slot 208 (i.e., which ink color), on which printhead 114, on which print module 103, is to be used to print an upcoming image or image portion. The controller 110 then selects one of the two nozzle columns, 204*a* or 204*b*, adjacent to the fluid/ink slot 208 to print the upcoming image or image portion. The nozzle column selection is based on a user-selected print mode from module 131, or it is based on a determination made by module 132 as to the type of image content to be printed (i.e., text/line content, or graphics and area fill content). For example, referring to FIG. 2, upcoming image content indicated by a user-selected print mode to be text and lines content, or determined by module 130 to be text and lines content, may be printed using nozzle column 204*a*. As another example, upcoming image content indicated by a user-selected print mode to be graphics or area fill content, or determined by module 130 to be graphics or area fill content, may be printed using nozzle column 204*b*. In some examples, where analysis of the image content determines that there is both text/line content, and graphics/area fill content, the print mode can be alternated such that nozzle columns alternately print each portion of the image content. For example, for the images in FIG. 4, the print mode can alternate between a text/line mode and a graphics/area fill mode within a given media page 118, or within a given image, such as with image 402 which contains both text/line content and graphics/area fill content. Thus, the nozzle columns 204*a* and 204*b* can be selected alternately to print the different image content areas. For example, nozzle column 204*a* may print a portion of text and line image content, followed by nozzle column 204*b* printing a portion of graphics image content, and so on. In other examples, where analysis of the image content determines that there is both text/line content, and graphics/area fill content, a nozzle column can be selected based on what proportions of different image content is present. For example, nozzle column 204*a* may be selected if the image content is all text and line content, or, if there is a greater proportion of text and lines content to graphics content. In still other examples where an image content analysis determines a mix of text/line content and graphics/area fill content, other nozzle column selection outcomes are possible. For example, because graphics/area fill defects are generally more objectionable than text/line defects, content that includes a mix of text/line content and graphics/area fill content may cause a nozzle column selection that defaults to the column that favors the graphics/area fill content, such as nozzle column 204*b*, in keeping with the above examples. Another nozzle column selection outcome can be to use both nozzle columns 204*a* and 204*b* when mixed image content is determined. In general, module 132 executes to select a nozzle column 204 whose nozzles 116 have features that are best suited to produce ink drops that form ink dots on a media page 118 that optimize the print quality of the type of image content to be printed.

Accordingly, nozzle columns 204*a* and 204*b* adjacent to an ink slot 208 on a printhead 114 are designed to have different features to enable one nozzle column (e.g., 204*a*) to produce ink drops that form ink dots on a media page 118 that optimize the print quality of text and lines image content, and to enable the other nozzle column (e.g., 204*b*) to produce ink drops that form ink dots on a media page 118 that optimize the print quality of graphics and area fill image content. Thus, one nozzle column 204*a* to receive a first ink color from an ink slot 208 has nozzles with a given feature, while another nozzle column 204*b* to receive the same first ink color from the same ink slot 208 has nozzles with a different feature. The nozzle features can involve various aspects associated with the nozzle 116 including, for example, nozzle shape, nozzle concentricity, nozzle size/diameter, the presence of a nozzle counterbore, the number of nozzle openings, the size of an associated resistive ejection element, and the offset of an associated resistive ejection element with respect to the nozzle. Thus, in some examples a first nozzle column 204*a* can have first nozzles with one or multiple first nozzle features such as a particular nozzle shape, nozzle concentricity, nozzle diameter, nozzle counterbore, number of nozzle openings, size of an associated resistive ejection element, and offset of an associated resistive ejection element with respect to the nozzle, while a second nozzle column 204*b* can have second nozzles with one or multiple corresponding second nozzle features that have a different nozzle shape, nozzle concentricity, nozzle diameter, nozzle counterbore, number of nozzle openings, size of an associated resistive ejection element, and offset of an associated resistive ejection element with respect to the nozzle. In general, such nozzle features can function to control whether the tail of an ink drop lands on the head of the ink drop when they impact the media page 118. For example, nozzle shape and concentricity features affect how an ink drop tail breaks off the ink drop, as well as the direction of the ink drop. The number of nozzle openings impacts the size and shape of the ink drop. The size of the associated resistive ejection element and the nozzle size/diameter impact the ink drop velocity and the length of the drop tail, both of which impact the shape of the resulting ink dot on the media page. The offset of the associated resistive ejection element with respect to the nozzle impacts the ink drop tail break off and the ink drop direction. These ink drop characteristics determine the shape of the ink dot on the media page, which as noted above can be used to optimize print quality for a given type of image content such as text and lines, or graphics and area fill.

Figure 5:
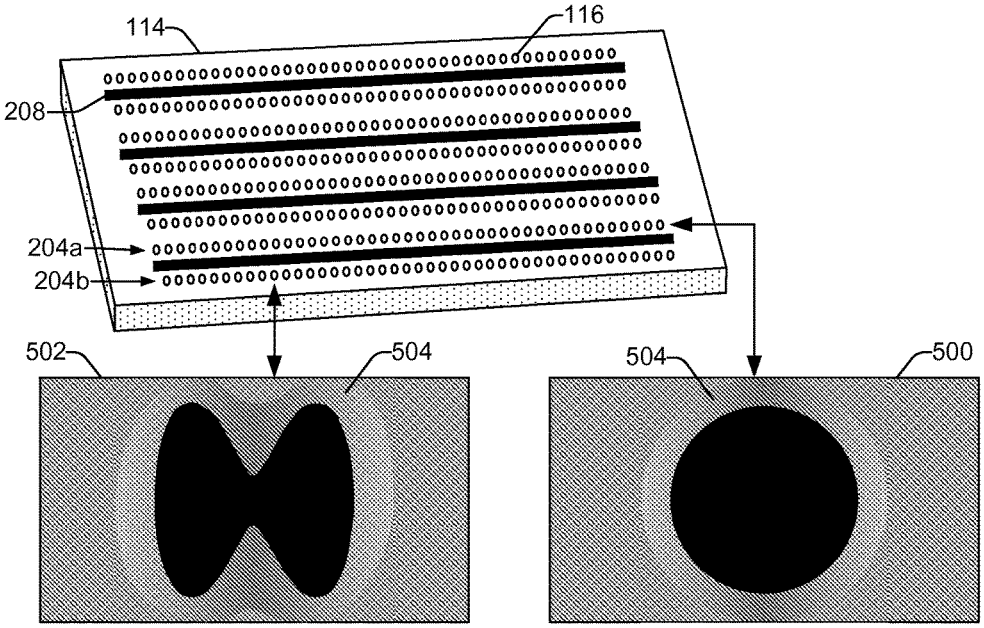
FIG. 5 shows an example of a printhead with two nozzle columns having nozzles with varying nozzle shape features.

FIG. 5 illustrates an example of printhead 113 with nozzle columns 204*a* and 204*b* having nozzles 116 with varying nozzle shape features. As shown in FIG. 5, the nozzles 116 in nozzle column 204*a* have a circular shape 500, and the nozzles 116 in nozzle column 204*b* have a non-circular shape 502. The nozzles in both columns have a counterbore 504. Circular nozzles 500 are easy to manufacture and have a high resistance to clogging. However, ink drops ejected from the circular nozzles have velocity differences which can tear apart the drops during ejection. Specifically, the violent retraction of the ink drop tail during drop ejection can shatter the trailing portion of the drop tail, and the velocity differences between the drop head and the leading portion of the drop tail can cause separation of the ink drop head from the ink drop tail. This can result in the drop tail not landing on the drop head, which can produce ink dot shapes on the media page that are not ideal for providing the clear, sharp edges desired for printing high quality text and line image content. High print quality for text and line image content is better achieved through clear and sharp edges that can be created when the tail of the ink drop lands on the head of the ink drop as the drop hits the media page. Consequently, circular shaped nozzles 500 are not ideal for printing text and line image content.

However, by using a non-circular shape for inkjet nozzles 116, the velocity differences between the drop tail and the drop head can be reduced. As shown in FIG. 5, the nozzles 116 in nozzle column 204*b* have a non-circular shape 502. More specifically, the nozzles 116 in nozzle column 204*b* have a non-circular, poly-elliptical shape 502. In general, the resistance to fluid flow out of the nozzle 116 is proportional to the cross-sectional area of a portion of the nozzle. Thus, parts of the nozzle having smaller cross sections have higher resistance to fluid flow. During a drop ejection, higher fluid volumes and velocities emerge from the more open cross-sections of the nozzle opening. The middle, more restricted cross-section of the nozzle opening has a higher resistance to fluid flow and results in the ink drop tail being centered in the middle of the nozzle opening which keeps the drop tail aligned with the drop head. This improves drop directionality and causes the drop tail to land on the drop head as the drop hits the media page. Accordingly, the nozzles 116 in the nozzle column 204*b* having the feature of a non-circular nozzle opening are better suited to produce high print quality text and line image content than circular nozzles in nozzle column 204*a*.

Figure 6:
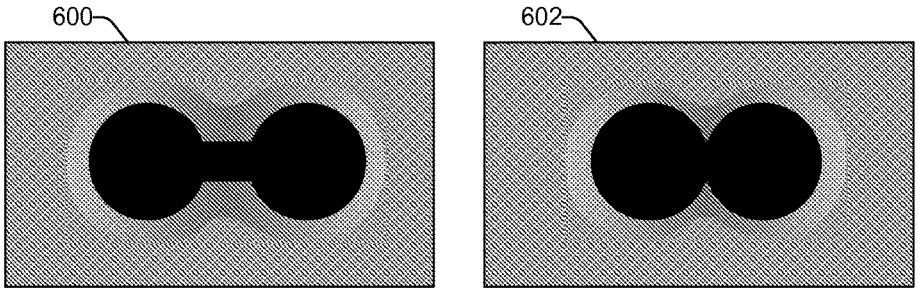
FIG. 6 shows additional examples of non-circular nozzle shapes.

Numerous other non-circular nozzle shapes can also provide varying degrees of improved drop directionality with drop tails landing on drop heads. FIG. 6 illustrates two additional non-circular nozzle shapes 600 and 602 as examples of non-circular nozzle shapes that may be useful in nozzle column 204*b* to improve print quality for text and line image content. Non-circular nozzle shape 600 generally comprises a dumbbell-shaped nozzle opening while non-circular nozzle shape 602 comprises a FIG. 8 shaped nozzle opening.

As noted above, other differences in nozzle features from one nozzle column (e.g., 204*a*) to the other nozzle column (e.g., 204*b*) can also enable the nozzle columns to produce differently shaped ink dots that can be used to optimize print quality for different types of image content (e.g., text and lines image content, and graphics and area fill image content). These features include, but are not limited to, nozzle concentricity, nozzle size/diameter, the presence of a nozzle counterbore, the number of nozzle openings, the size of an associated resistive ejection element, and the offset of an associated resistive ejection element with respect to the nozzle. In some examples, differences in nozzle features can be combined to produce differently shaped ink dots to optimize print quality for different types of image content. For example, nozzles in nozzle column 204*a* may have circular nozzle shapes and resistive ejection elements of a first size, while nozzles in nozzle column 204*b* may have non-circular nozzle shapes and resistive ejection elements of a second size.

Figure 7A:
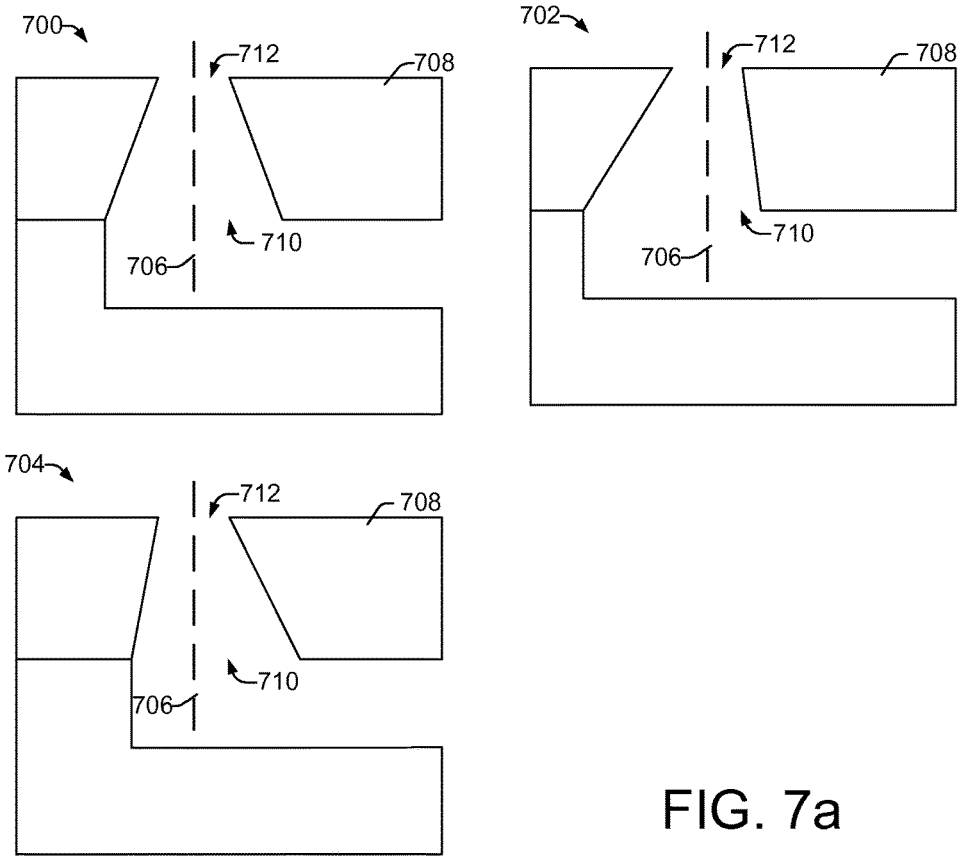
FIG. 7*a* shows examples of nozzles having different nozzle concentricity features.
Figure 7B:
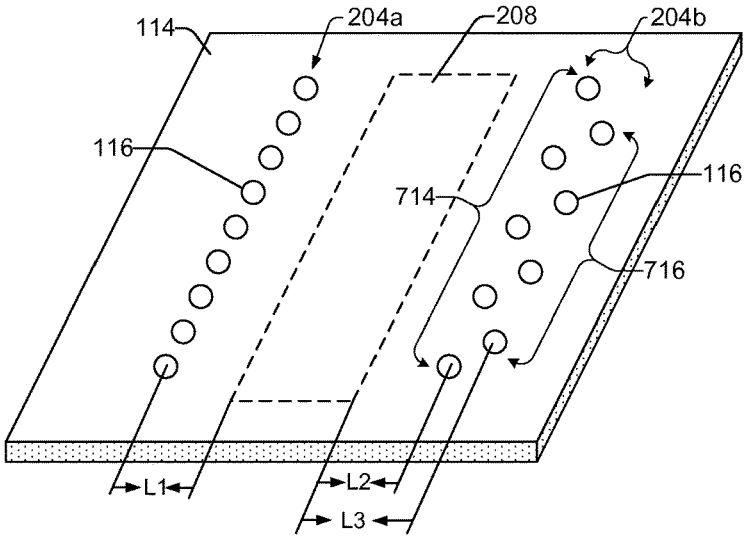
FIG. 7*b* shows examples of nozzles in the two nozzle columns that have different nozzle shelf length features.

FIGS. 7*a* and 7*b* illustrate additional examples of different nozzle features that can be implemented in two nozzle columns of a printhead 114, such as nozzle columns 204*a* and 204*b*. More specifically, FIG. 7*a* illustrates examples of nozzles 700, 702, and 704, having different nozzle concentricity. In general, nozzle concentricity refers to the condition in which a nozzle's axis of symmetry 706, runs perpendicular to the flat surface of the nozzle plate 708. A concentric nozzle has an entrance 710 and exit 712 that are in alignment, while a non-telecentric nozzle has an entrance 710 and exit 712 that are not aligned, and has the nozzle tipped off axis, which is usually an undesirable condition. As shown in FIG. 7*a*, nozzle 700 is concentric as its entrance 710 and exit 712 are aligned. By contrast, both nozzles 702 and 704 are not concentric, because their entrances 710 and exits 712 are not aligned. In nozzle 702 the entrance 710 is shifted to the left with respect to the exit 712, while in nozzle 704, the entrance 710 is shifted to the right with respect to the exit 712. In some examples, the different nozzle concentricity features can be use in different nozzle columns. Thus, in an example printhead 114, concentric nozzle 700 might be used in a nozzle column 204*a*, while non-concentric nozzle 702 might be used in a nozzle column 204*b*. In another example, concentric nozzle 700 might be used in a nozzle column 204*a*, while non-concentric nozzle 704 might be used in a nozzle column 204*b*. In general, different parts of the nozzle architecture (e.g., the entrance and exit) are involved in the formation of the ink drop head and tail, which as noted above, play a significant role in determining dot shapes. Different dot shapes can be advantageous when printing a particular type of image content, such as text and lines, or graphics and area fill.

Referring now to FIG. 7*b*, nozzles in the two nozzle columns 204*a* and 204*b* have different shelf length features. The nozzle shelf length refers to the distance between the center of the nozzle and the edge of the ink slot 208. As shown in FIG. 7*b*, nozzles in nozzle column 204*a* are arrayed in a "single inline" architecture with the shelf length of each nozzle being the same length or distance, L1. Thus, each nozzle (i.e., nozzle center) in nozzle column 204*a* is an equal distance L1 away from the ink slot 208. However, nozzles in nozzle column 204*b* are arrayed in a "dual inline" architecture with staggered shelf lengths, L2 and L3. Nozzles (i.e., nozzle centers) in a first group 714 within column 204*b* are a distance L2 (i.e., nozzle centers) away from the ink slot 208, while nozzles (i.e., nozzle centers) in a second group 716 within column 204*b* are a distance L3 away from the ink slot 208. In some examples, the shelf length may be useful as a nozzle feature to help produce differently shaped ink dots that can be used to optimize print quality for different types of image content. For example, the single-inline architecture may generate a repetitive sawtooth type of dot placement error that can be advantageous for printing graphics content, while the dual inline architecture with staggered shelf lengths may be advantageous for printing text and line content.

Figure 8:
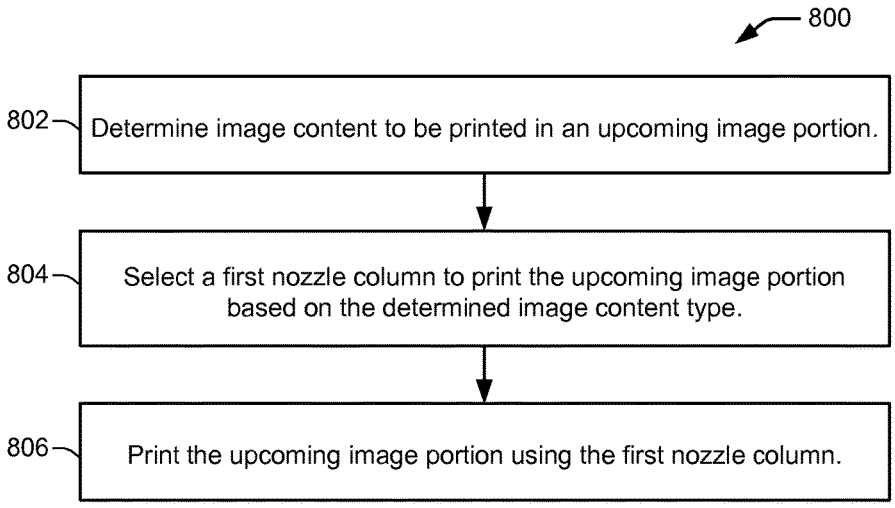
FIGS. 8 and 9 show flow diagrams that illustrate example methods for implementing fluid ejection devices having dynamically selectable nozzle columns with different nozzle features to print portions of images based on the type of image content being printed.
Figure 9:
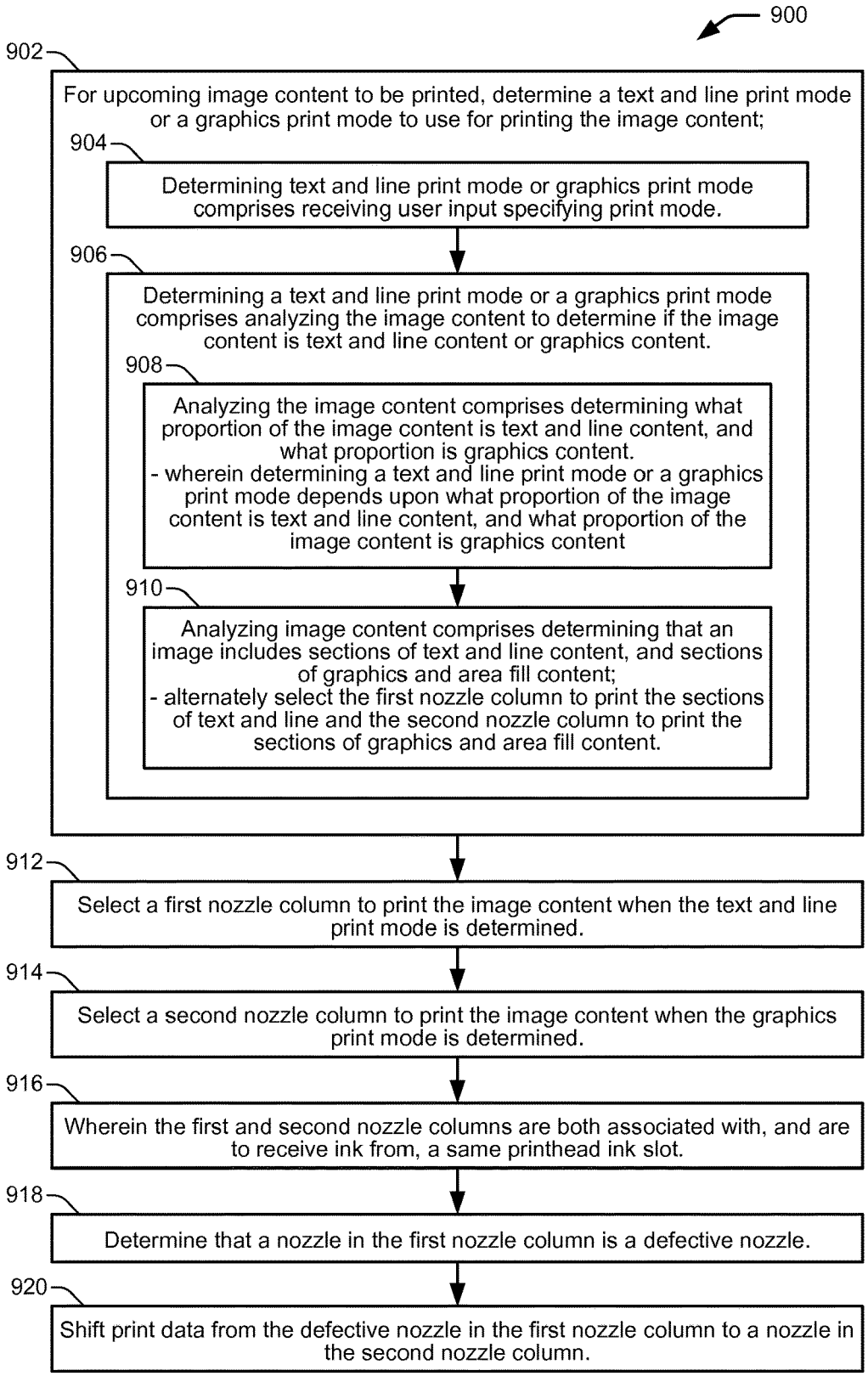

FIGS. 8 and 9 show flow diagrams that illustrate example methods 800 and 900 for implementing fluid ejection devices (e.g., printheads, print modules, print bars) having dynamically selectable nozzle columns with different nozzle features to print portions of an image based on the type of image content being printed. Methods 800 and 900 are associated with the examples discussed above with regard to FIGS. 1-7, and details of the operations shown in methods 800 and 900 can be found in the related discussion of such examples. The operations of methods 800 and 900 may be embodied as programming instructions stored on a non-transitory computer/processor-readable medium, such as memory 126 of FIG. 1. In some examples, implementing the operations of methods 800 and 900 can be achieved by a processor such as processor 124 of FIG. 1, reading and executing the programming instructions. In some examples, implementing the operations of methods 800 and 900 can be achieved using an ASIC 125 and/or other hardware components 127 alone or in combination with programming instructions executable by a processor.

Methods 800 and 900 may include more than one implementation, and different implementations of methods 800 and 900 may not employ every operation presented in the respective flow diagrams. Therefore, while the operations of methods 800 and 900 are presented in a particular order within the flow diagrams, the order of their presentation is not intended to be a limitation as to the order in which the operations may actually be implemented, or as to whether all of the operations may be implemented. For example, one implementation of method 900 might be achieved through the performance of a number of initial operations, without performing one or more subsequent operations, while another implementation of method 900 might be achieved through the performance of all of the operations.

Referring to the flow diagram of FIG. 8, an example method 800 begins at block 802 where a first operation includes determining an image content type to be printed in an upcoming image portion. As shown at block 804, based on the image content type determined at block 802, a first nozzle column is selected to print the image portion. The selection is made for a given ink slot that supplies ink to both a first and second nozzle column that are adjacent to the ink slot. The upcoming image portion is then printed using the first nozzle column, as shown at block 806.

Referring to the flow diagram of FIG. 9, an example method 900 begins at block 902 where a first operation includes determining a text and line print mode or a graphics print mode to use for printing upcoming image content to be printed. As shown at block 904, in some examples determining the text and line print mode or graphics print mode comprises receiving user input specifying the print mode. As shown at block 906, in some examples determining a text and line print mode or a graphics print mode comprises analyzing the image content to determine if the image content is text and line content or graphics content. Analyzing the image content can comprise determining what proportion of the image content is text and line content, and what proportion of the image content is graphics content, as shown at block 908. When analyzing the image content comprises determining what proportion of the image content is text and line content, and what proportion of the image content is graphics content, determining a text and line print mode or a graphics print mode as shown at block 902 can depend upon what proportion of the image content is text and line content, and what proportion of the image content is graphics content. As shown at block 910, in some examples analyzing image content comprises determining that an image includes sections of text and line content, and sections of graphics and area fill content. In this case alternating selections can be made between the first nozzle column to print the sections of text and line and the second nozzle column to print the sections of graphics and area fill content.

The method 900 continues at block 912 with selecting a first nozzle column to print the image content when the text and line print mode is determined. However, when the graphics print mode is determined, the method 900 includes selecting a second nozzle column to print the image content, shown at block 914. As shown at block 916, the first and second nozzle columns are both associated with, and are to receive ink from, a same printhead ink slot. As shown at block 918, in some examples the method 900 includes determining that a nozzle in the first nozzle column is a defective nozzle. When a nozzle in the first nozzle column is determined to be a defective nozzle print data can be shifted from the defective nozzle in the first nozzle column to a nozzle in the second nozzle column, as shown at block 920.

What is claimed is:

1. A non-transitory processor-readable medium storing code representing instructions that when executed by a processor cause a printing system to:

for upcoming image content to be printed on a single media page, determine a text and line print mode for a portion of the image content that is text and line content, and determine a graphics print mode for a portion of the image content that is graphics content, such that a print mode alternates between the text and line print mode and the graphics print mode within the image content and within the single media page;

select a nozzle comprising a non-circular nozzle bore feature from nozzles on a first side of a fluid slot to print the text and line content when the text and line print mode is determined, wherein all nozzles on the first side of the fluid slot comprise the non-circular nozzle bore feature and are arrayed with equal shelf lengths to form a first nozzle column; and select a nozzle comprising a circular nozzle bore feature from nozzles on a second side of the fluid slot to print the graphics content when the graphics print mode is determined, wherein all nozzles on the second side of the fluid slot comprise the circular nozzle bore feature and are arrayed with equal shelf lengths to form a second nozzle column;

wherein in nozzles in the first nozzle column and nozzles in the second nozzle column are arranged along the printhead length such that each nozzle in the first nozzle column has a same lengthwise position on the printhead as a corresponding nozzle in the second nozzle column, each nozzle in the first nozzle column being directly across the fluid slot from its corresponding nozzle in the second nozzle column.

2. A medium as in claim 1, wherein determining a text and line print mode or a graphics print mode comprises receiving user input information specifying a print mode.

3. A medium as in claim 1, wherein determining a text and line print mode or a graphics print mode comprises analyzing the image content to determine if the image content is text and line content or graphics content.

4. A medium as in claim 3, wherein analyzing the image content comprises determining what proportion of the image content is text and line content, and what proportion of the image content is graphics content.

5. A medium as in claim 4, wherein determining a text and line print mode or a graphics print mode depends upon what proportion of the image content is text and line content, and what proportion of the image content is graphics content.

6. A medium as in claim 1, wherein analyzing the image content comprises determining that an image includes sections of text and line content, and sections of graphics and area fill content, the instructions further causing the printing system to:

alternately select the first nozzle column to print the sections of text and line and the second nozzle column to print the sections of graphics and area fill content.

7. A medium as in claim 1, wherein the first and second nozzle columns are both associated with, and are to receive ink from, the fluid slot.

8. A medium as in claim 1, the instructions further causing the printing system to:

determine that a nozzle in the first nozzle column is a defective nozzle; and shift print data from the defective nozzle in the first nozzle column to a nozzle in the second nozzle column.

9. A printhead comprising:

a fluid slot to supply ink to nozzles on a first side of the slot, wherein all of the nozzles on the first side of the slot have equal shelf lengths and form a first nozzle column of first nozzles arrayed in a single inline architecture along the first side of the slot, the fluid slot additionally to supply ink to nozzles on a second side of the slot, wherein all of the nozzles on the second side of the slot have equal shelf lengths and form a second nozzle column of second nozzles arrayed in a single inline architecture along the second side of the slot opposite the first side;

wherein the first nozzles and second nozzles are arranged along the printhead length such that each first nozzle on the first side of the slot has a same lengthwise position on the printhead as a corresponding second nozzle on the second side of the slot, each first nozzle being directly across the slot from its corresponding second nozzle;

wherein each first nozzle comprises a non-circular nozzle bore feature and is selectable to print text and line image content based on the non-circular nozzle bore feature; and, wherein each second nozzle comprises a circular nozzle bore feature and is selectable to print graphics and area fill image content based on the circular nozzle bore feature.

10. A printhead as in claim 9, comprising:

ejection elements associated with the first nozzles that are controlled to eject ink from the first nozzles during a text and line print mode; and ejection elements associated with the second nozzles that are controlled to eject ink from the second nozzles during a graphics print mode.

11. A printhead as in claim 9, wherein the first nozzles comprise non-concentric nozzles each having a nozzle entrance and nozzle exit that are not in alignment, and the second nozzles comprise concentric nozzles each having a nozzle entrance and nozzle exit that are in alignment.

12. A printhead as in claim 11, wherein the first nozzles and the second nozzles each comprise a nozzle counterbore.

13. A method comprising:

determining an image content type to be printed from an upcoming image portion;

in a printhead having an ink slot to supply ink to nozzles on a first side of the slot, all of the nozzles on the first side of the slot having first nozzle features and forming a first column of nozzles arrayed with equal shelf lengths in a single inline architecture, and to supply ink to nozzles on a second side of the slot, all of the nozzles on the second side of the slot having second nozzle features and forming a second column of nozzles arrayed with equal shelf lengths in a single inline architecture, wherein the nozzles are arranged along the printhead length such that each nozzle on the first side of the slot is directly across the slot from, and has a same lengthwise position on the printhead as, a corresponding nozzle on the second side of the slot, selecting either the first column of nozzles or the second column of nozzles to print the upcoming image portion based on the determined image content type; and printing the upcoming image portion using the selected column of nozzles.

14. A method as in claim 13, further comprising:

receiving a user-selected input mode; and determining the image content type to be printed based on the user-selected input mode.

* * * * *